US008689476B2

(12) United States Patent
Emde

(10) Patent No.: US 8,689,476 B2
(45) **Date of Patent: *Apr. 8, 2014**

(54) HAND GUN

(75) Inventor: Dietmar Emde, Arnsberg (DE)

(73) Assignee: German Sport Guns GmbH, Ense-Hoingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/597,845

(22) Filed: Aug. 29, 2012

(65) Prior Publication Data

US 2012/0317858 A1 Dec. 20, 2012

Related U.S. Application Data

(62) Division of application No. 12/947,410, filed on Nov. 16, 2010, now Pat. No. 8,381,425.

(30) Foreign Application Priority Data

Dec. 11, 2009 (DE) ..... 10 2009 057 864

(51) Int. Cl.
*F41A 17/34* (2006.01)

(52) U.S. Cl.
USPC ..... 42/70.02

(58) Field of Classification Search
USPC ..... 42/70.01, 70.02, 71.01, 71.02
See application file for complete search history.

(56) References Cited

U.S. PATENT DOCUMENTS

| | | | | |
|---|---|---|---|---|
| 2,090,657 A | | 8/1937 | Williams | |
| 3,504,594 A | | 4/1970 | Greeley | |
| 3,657,959 A | | 4/1972 | Kart | |
| 3,722,358 A | * | 3/1973 | Seecamp | 89/147 |
| 3,724,326 A | | 4/1973 | Day | |
| 3,990,169 A | | 11/1976 | Jennie et al. | |
| 4,155,187 A | | 5/1979 | Lichtman | |
| 4,253,377 A | | 3/1981 | Arnett | |
| 4,590,698 A | | 5/1986 | Finn | |
| 4,644,930 A | | 2/1987 | Mainhardt | |
| 4,709,497 A | * | 12/1987 | Resca | 42/75.02 |
| 4,897,949 A | | 2/1990 | Whiteing | |
| 4,914,845 A | | 4/1990 | Reese et al. | |
| 4,920,676 A | | 5/1990 | Peters | |
| 5,194,677 A | * | 3/1993 | Schuemann | 42/71.02 |

(Continued)

FOREIGN PATENT DOCUMENTS

| | | |
|---|---|---|
| DE | 295898 | 12/1916 |
| DE | 1002009057864 A1 | 6/2011 |
| EP | 0278795 A1 | 1/1988 |

*Primary Examiner* — Bret Hayes

(74) *Attorney, Agent, or Firm* — Maine Cernota & Rardin

(57) ABSTRACT

A changeover system is provided for a hand gun comprising at least two different barrels, able to be applied exchangeably on a first grip piece of a weapon, for bullets of different caliber, with at least two different magazines for cartridges of different caliber able to be applied exchangeably on a first grip piece of a weapon. Such a system has at least a second grip piece of the same weapon type, provided for a smaller caliber, on which at least one security arrangement against interchange is provided, which prevents the application of a barrel and/or of a magazine of a larger caliber on the grip piece provided for a smaller caliber. The user of a second large-caliber weapon can then mount components of the small-caliber weapon onto the grip piece of the large-caliber weapon, in order to fire small-caliber ammunition therewith, for example for training purposes.

7 Claims, 3 Drawing Sheets

(56) References Cited

U.S. PATENT DOCUMENTS

| | | | | |
|---|---|---|---|---|
| 5,293,708 | A * | 3/1994 | Strayer et al. | 42/75.03 |
| 5,461,811 | A | 10/1995 | Ciener | |
| 5,704,148 | A * | 1/1998 | Valorose | 42/50 |
| 5,845,426 | A * | 12/1998 | Valorose | 42/49.02 |
| 6,070,352 | A * | 6/2000 | Daigle | 42/49.02 |
| 6,276,252 | B1 | 8/2001 | Dionne | |
| 7,444,775 | B1 * | 11/2008 | Schuetz | 42/76.01 |
| 7,934,443 | B1 * | 5/2011 | Bennett | 89/33.14 |
| 8,028,455 | B1 * | 10/2011 | Battaglia | 42/49.02 |
| 8,312,659 | B2 * | 11/2012 | Emde | 42/70.01 |
| 2002/0116857 | A1 | 8/2002 | Wonisch et al. | |
| 2006/0064914 | A1 | 3/2006 | Greer | |
| 2006/0080881 | A1 * | 4/2006 | Cuprin et al. | 42/70.02 |
| 2011/0107638 | A1 * | 5/2011 | Emde | 42/6 |

* cited by examiner

HAND GUN

RELATED APPLICATIONS

This application is a Divisional of U.S. application Ser. No. 12/947,410, filed Nov. 16, 2010, which claims priority from German Application No. DE 10 2009 057 864.1, filed Dec. 11, 2009. Each of these applications is herein incorporated by reference in their entirety for all purposes.

FIELD OF THE INVENTION

The present invention relates to a changeover system for a hand gun comprising at least two different barrels for bullets of a different caliber, able to be applied exchangeably on a first grip piece of a weapon, and/or at least two different magazines for cartridges of a different caliber, able to be applied exchangeably on a first grip piece of a weapon. Such a changeover system permits the conversion of a weapon to a different caliber.

BACKGROUND OF THE INVENTION

In the prior art, proposals have existed for a long time for changeover systems which are suited, by the exchange of particular components, to converting a weapon which is originally provided for example for a larger caliber into a weapon for ammunition having a smaller caliber. This is expedient in particular in order to provide a weapon in this way by which more favourably-priced small-caliber ammunition is fired for practice purposes, wherein the conversion to the large-caliber weapon of the original type is to be able to be carried out with as little effort as possible. Such a weapon is described in U.S. Pat. No. 5,461,811, in which the magazine is exchanged, wherein the replacement magazine for small-caliber ammunition has the same external dimensions as the original magazine for the large-caliber ammunition, so that there is a certain compatibility in the respective magazines. However, in the case of this weapon it is necessary to also exchange the barrel and housing on changing the caliber for adaptation to the new caliber, wherein these components generally have different dimensions. The named publication does not contain any actual embodiments for this.

In U.S. Pat. No. 6,276,252 B1 a firearm is described, in which a training barrel is used for the conversion to small-caliber ammunition. Whereas when shooting with large-caliber ammunition the barrel slides back a certain distance with the slide after the shot, when shooting small-caliber ammunition, there is no locking between the barrel and the slide, so that the training barrel does not move back on firing. As the intermediate space between the inlet of the cartridge chamber and the upper side of the magazine is too great when using the training barrel, with this use an extension of the feed ramp in the form of a separate component is inserted into the weapon. In such a known firearm, however, there is an aim that it can be converted comparatively simply by the user from the variant with training barrel into the original large-caliber weapon by changing the barrel and removing the feed ramp extension. When the barrel for the smaller caliber is exchangeable with the corresponding components of a large-caliber weapon of the same type of construction, it cannot be prevented that the owner of a small-caliber weapon converts this to a large-caliber weapon by exchanging the barrel, which, however, is questionable due to the different legal provisions concerning weapons. The known solution therefore only applies to persons who legally own a large-caliber weapon and for example shoot with this small-caliber ammunition for training purposes.

SUMMARY OF THE INVENTION

The present invention, on the other hand, pursues a different aim. It may be applied not only to those persons who already legally own a large-caliber weapon, but also to those who are authorized to own a small-caliber weapon and wish to possess a small-caliber weapon which is substantially identical in its external appearance to that of a large-caliber weapon which is available on the market. When the two weapons are largely the same as each other in construction and are identical in their external appearance, it is, however, desirable to be prevented that the person who is only permitted to own a small-caliber weapon converts it to a large-caliber weapon by ex-changing the barrel, magazine or other components. In addition, the conversion of the small-caliber weapon to the larger caliber is also to be prevented on the grounds of technical safety, because in the case of a conversion, components of the small-caliber weapon for example owing to the materials used, do not withstand the compressive stresses with the firing of ammunition having the larger caliber, and often therefore no permission for the larger caliber is present under firearms law.

An object of the present invention therefore consists in providing a changeover system for a hand gun of the type named in the introduction, which is designed so that the conversion of the large-caliber weapon to the smaller caliber is possible, but not, vice versa, the conversion of the small-caliber weapon to the larger caliber.

The solution to this problem is provided by a changeover system for a hand gun of the type described above, having the characterizing features of the main claim.

According to one aspect of the invention, provision is made that the changeover system comprises at least a second grip piece, provided for a smaller caliber, of the same weapon type, on which at least one security arrangement against interchanging is provided, which prevents the arranging of a barrel and/or of a magazine of a larger caliber on the grip piece which is provided for a smaller caliber.

A solution according to this embodiment of the invention enables for example the user of a large-caliber firearm to convert this to a smaller caliber by exchanging the barrel and/or the magazine, in order to fire more favorably priced small-caliber ammunition for example for training purposes. It is advantageous here that the existing large-caliber weapon basically retains its typical appearance and its external dimensions, so that on the one hand no readjustment in the usual handling is necessary. The magazine provided for the smaller caliber fits into the grip piece of the existing large-caliber weapon or respectively the barrel provided for the smaller caliber fits onto the grip piece of the large-caliber weapon. If required, the weapon can be converted in a relatively short time and with reasonable assembly effort to the respective other caliber.

On the other hand, however, the security arrangement may prevent against interchange that the user of a small-caliber weapon, who for example only has authorization to own the small-caliber weapon, converts it to a large-caliber weapon by exchanging the barrel and/or magazine. The person who only acquires the small-caliber weapon can therefore only shoot with the smaller caliber. Only the person who in addition also owns a weapon of the larger caliber of the same weapon type can dismantle components of the small-caliber weapon such as the barrel or magazine therefrom and mount them onto the grip piece of the large-caliber weapon.

In contrast to the known solutions from the prior art cited in the introduction, embodiments of the invention do not necessarily aim only to provide exchangeable barrels or magazines or different caliber for a large-caliber weapon, but the changeover system can for example comprise a complete small-caliber weapon of the same weapon type, which can be used as such in itself. If required, the owner of an additional large-caliber weapon can then mount components of the small-caliber weapon onto the grip piece of the large-caliber weapon, in order to fire small-caliber ammunition therewith for example for training purposes. The risk that the barrel or the magazine of the large-caliber weapon are mounted by mistake onto the grip piece of the small-caliber weapon does not, however, exist, because this is prevented by the security arrangement(s) against interchange on the grip piece of the small-caliber weapon.

According to a preferred further embodiment of the present invention, provision is made that at least one security arrangement comprises at least one engagement element on the grip piece, which enters into a form-fitting engagement with a corresponding engagement element on the barrel block provided for the smaller caliber, with this corresponding engagement element not being present on the barrel block provided for the larger caliber, so that it is not possible to mount on the grip piece the barrel block which is provided for the larger caliber.

This engagement element on the grip piece can, for example, be a projecting element, in particular a cam, a spring or a projection, and the corresponding engagement element on the barrel block provided for the smaller caliber can be a correspondingly shaped introverted element, in particular a depression, bore or groove or suchlike, or vice versa.

According to a possible preferred further embodiment of the invention, the at least one corresponding engagement element on the barrel block, provided for the smaller caliber, is arranged laterally beneath the barrel. This region is generally held by the grip piece, so that only the barrel block of the small-caliber weapon, provided with the engagement element, fits into the corresponding grip piece of the small-caliber weapon.

In the security against an interchange of the respective magazines, provision is made that at least one security arrangement is formed by a partial constriction in the magazine mounting in the interior of the grip piece, which cooperates with a corresponding narrower section on the magazine provided for the smaller caliber, with this narrower section not being present on the magazine provided for the larger caliber, so that it is not possible to insert the magazine provided for the larger caliber into the magazine mounting of the grip piece of the smaller caliber.

A preferred further embodiment of the invention makes provision that the narrower section on the magazine provided for the smaller caliber is situated in a front region of this magazine, viewed in the insertion direction. The magazine provided for the larger caliber therefore cannot be inserted into the magazine mounting on the grip piece of the small-caliber weapon. When the magazine provided for the smaller caliber has in a further partial section a greater width which corresponds to that of the original width of the large-caliber magazine, this can be advantageous, because then the small-caliber magazine sits in this partial section free of play in the magazine of the large-caliber weapon.

The constriction in the grip piece of the weapon provided for the smaller caliber can for example begin approximately at the height of the trigger, so that the magazine mounting is narrower in the section lying above this region. Alternatively to this, it is also possible for example to apply a similar solution in the interchange security arrangement for the magazine as in the interchange security arrangement for the barrel, by engagement elements, corresponding with each other, being provided for example on the magazine and on the magazine mounting, so that an insertion of the magazine is only possible when for example a groove, depression, notch or suchlike is formed thereon, into which a corresponding element in the magazine mounting then engages. The magazine for the large-caliber weapon does not have this engagement element, so that the large-caliber magazine cannot be inserted into the magazine mounting of the grip piece of the small-caliber weapon.

An additional embodiment of the invention is a changeover system for a hand gun of the above-mentioned type, which comprises a first complete weapon, which is only intended for the smaller caliber, and in its external appearance and in the external dimensions is largely identical to a weapon of the same type of construction provided for a larger caliber, wherein this complete weapon has the grip piece with the security arrangement against interchange. In this case, the user can acquire a complete weapon for the smaller caliber, the components of which he can remove from this weapon, if required, and mount onto an existing weapon for a larger caliber. The advantage compared with the known systems consists in that the user then also has a complete small-caliber weapon, which if required is immediately able to function without conversion.

In a further preferred embodiment of the invention, the changeover system comprises a second complete weapon which is intended for the larger caliber, wherein the barrel and/or the magazine of the first weapon intended for the smaller caliber is able to be applied on this second weapon by ex-changing. The user then has two complete weapons of different caliber, able to function and ready to fire. If required, the large-caliber weapon can also be converted into a small-caliber weapon by exchange of the barrel and/or magazine. A "downgrading" of the large-caliber weapon is therefore possible. Vice versa, however, an "upgrading" of the small-caliber weapon is not possible, because this is prevented by the interchange security arrangement on the small-caliber weapon.

A further embodiment of the present invention is a hand gun which is suited for use in a changeover system of the type according to the invention, wherein this has a grip piece on which at least one interchange security arrangement is provided, which prevents the arrangement of a barrel and/or of a magazine of a larger caliber on the grip piece which is provided for a smaller caliber.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
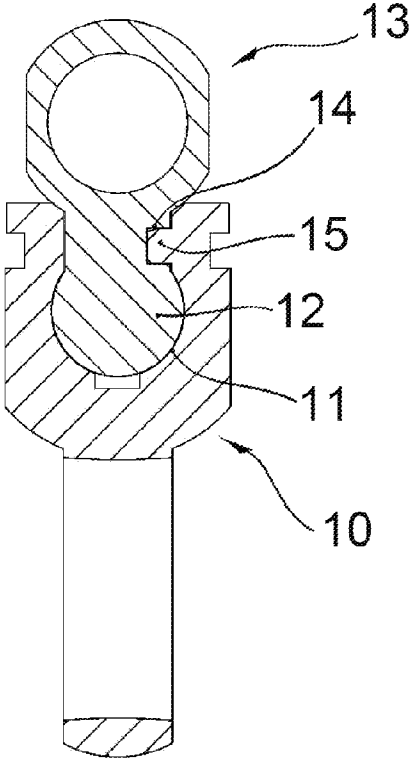
FIG. 1 a diagrammatically simplified vertical section through a grip piece of a firearm with barrel block and interchange security arrangement according to the present invention.

Firstly, reference is made to FIG. 1. The illustration shows in a diagrammatically simplified sectional view by way of example a grip piece 10 of a firearm according to the invention, which holds in an upper mounting 11 a barrel block 12, on which a barrel 13 is integrally arranged. This here is a barrel 13, which is provided for ammunition of a smaller caliber. The barrel block 12 and barrel 13 are held by the mounting 11 of the grip piece 10 on changing to a different caliber. In the present case, the grip piece 10 of a weapon of a smaller caliber is shown. As can be seen from FIG. 1, a groove 14 is situated on the barrel block 12 beneath the barrel 13. In the mounting 11 of the grip piece 10, there is now situated at a suitable location a cam 15, which fits into this groove 14 of the barrel block and on mounting of the barrel block is consequently held by this groove 14, so that a form-fitting connection between the barrel block 12 and the grip piece 10 is produced in this region.

This previously described groove 14 is only present here on the barrel block of the smaller caliber. Barrel blocks of other, larger calibers, which are provided for the same weapon type, do not have this groove, however, so that it is not possible to insert such a barrel block for a larger caliber into the grip piece 10 illustrated in FIG. 1. This can therefore be used exclusively in connection with the barrel block of the smaller caliber.

Figure 2:
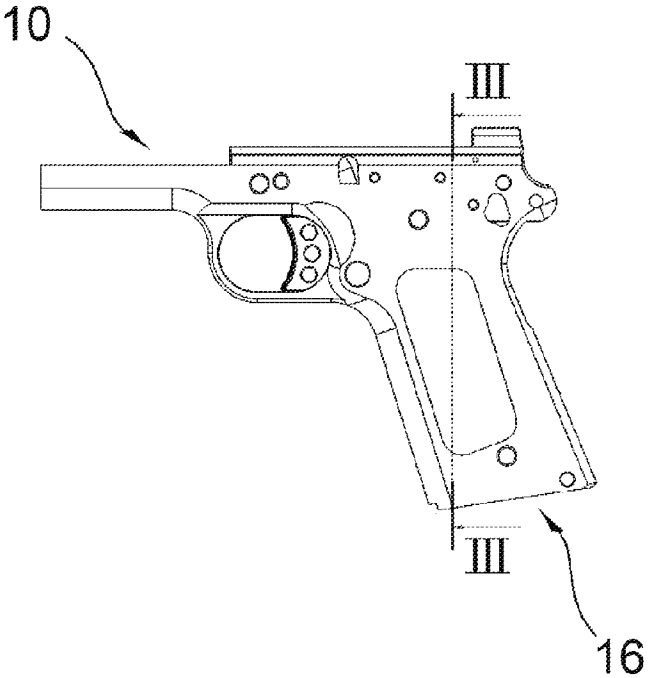
FIG. 2 a diagrammatically simplified side view of a firearm according to the invention.

Reference is made below to FIGS. 2 to 6 and with the aid thereof a further example embodiment of the present invention is explained. FIG. 2 shows a diagrammatically simplified side view of a grip piece 10 for a firearm. A magazine, which holds a store of cartridges, can be inserted from below into the magazine mounting 16 of this grip piece 10. The magazine mounting 16 of this grip piece is designed here so that only magazines of a smaller caliber can be inserted, so that it is ensured that only the small-caliber ammunition is fired with this grip piece.

Figure 4:
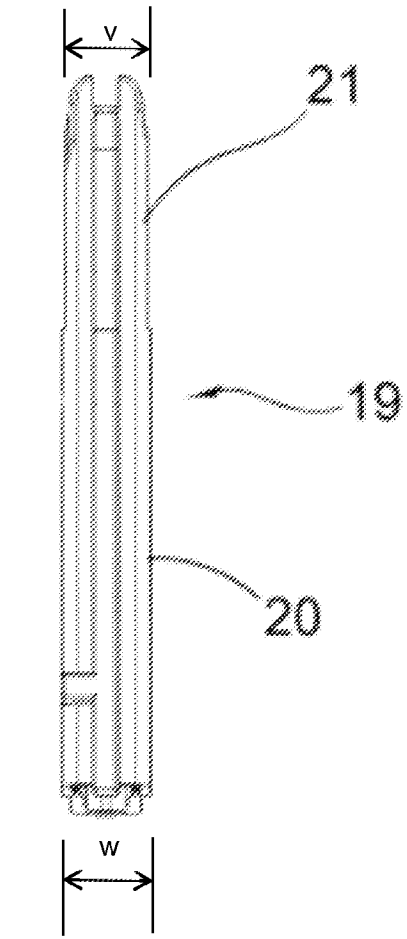
FIG. 4 a longitudinal section through a magazine intended for the magazine mounting in the grip piece of FIG. 3.
Figure 3:
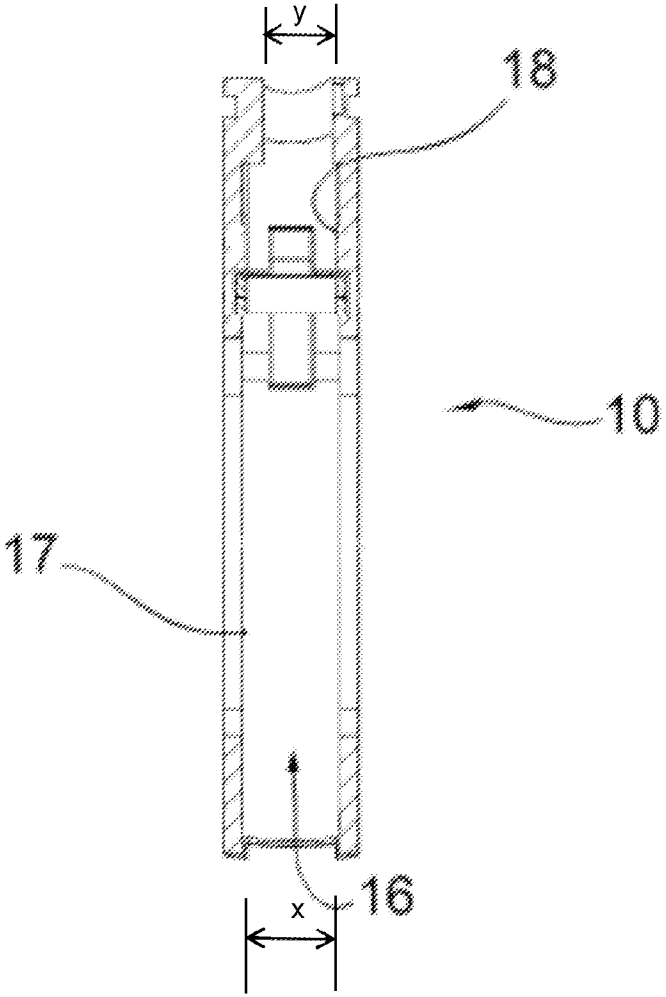
FIG. 3 a sectional view through the firearm without magazine along the line III-III in FIG. 2.

This construction of magazine mounting and magazine is explained in further detail with the aid of FIGS. 3 and 4. FIG. 3 shows the section along the line III-III through the grip piece of FIG. 2 and it can be readily seen that the magazine mounting 16 in the interior of the grip piece 10 has a lower, rear section 17 in the insertion direction of the magazine, in which there is the greatest insertion width (designated by "x"), which in this case corresponds to the original insertion width for magazines of a weapon of a larger caliber. In an upper section, i.e. in a front section 18 in the insertion direction of the magazine, the width of the magazine mounting, on the other hand, is smaller than in the section 17. This smaller width is designated by "y" or respectively "z". It is sufficient if the reduction in the insertion width is relatively small, in order to prevent a wider magazine, which is provided for a larger caliber, from being inserted fully into the magazine mounting of the grip piece. This wider magazine can only be inserted up to the beginning of the upper section 18, which lies approximately at a height between the trigger legs of the grip piece.

In FIG. 4 the magazine 19 is illustrated, which is provided for the ammunition with a smaller caliber and which is embodied so that it can be inserted fully into the magazine mounting 16 of the grip piece 10 illustrated in FIG. 3. This magazine has two sections which are different in their width, namely a lower wider section 20 and an upper narrower section 21. Through this narrower section 21, where the latter begins on the magazine, two small shoulders are formed respectively externally. The width of the magazine 19 in the lower wider section 20 is designated by "w" and the small width in the upper section 21 is designated by "v". These dimensions are selected so that the narrower upper section 21 fits into the upper section 18 of the magazine mounting 16 (see FIG. 3), whereas the wider lower section 20 is able to be inserted in an approximately fitting manner into the wider lower section 17 of the magazine mounting.

The magazine according to FIG. 4, provided for the ammunition with a smaller caliber, can of course also be inserted into a magazine mounting of the weapon provided for the larger caliber, because this has the lower width "x" over the entire length of the magazine mounting. Vice versa, on the contrary, it is not possible to insert the magazine provided for the larger caliber into the grip piece according to FIG. 3 with the upper narrower magazine mounting 16.

Figure 6:
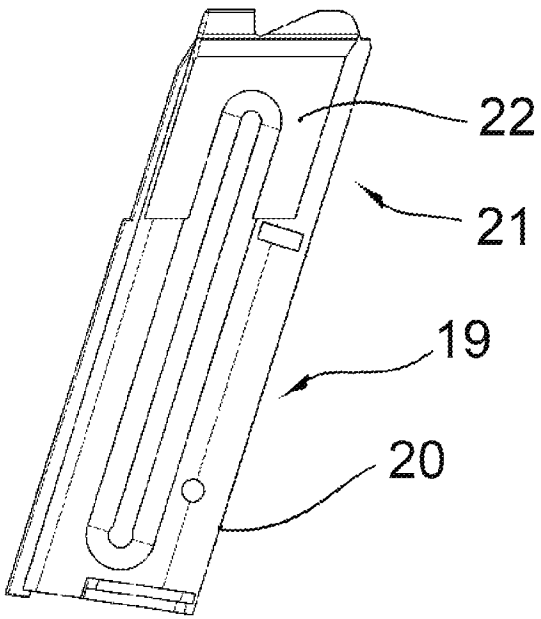
FIG. 6 a side view of the magazine of FIG. 4, viewed from the other side.
Figure 5:
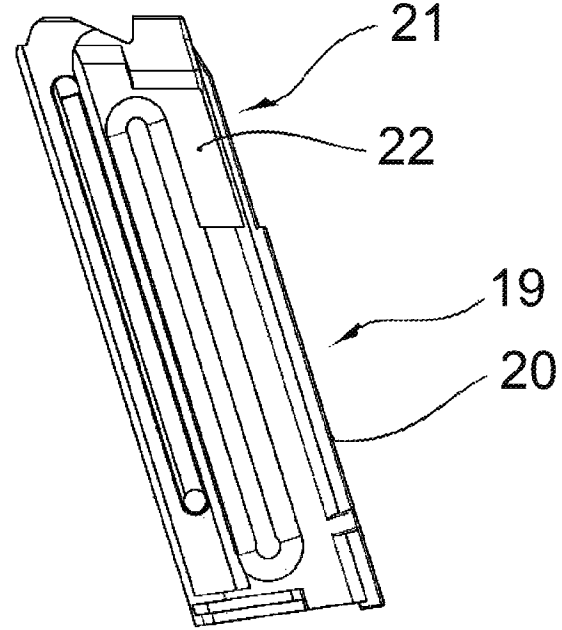
FIG. 5 a side view of the magazine of FIG. 4.

In FIGS. 5 and 6 the magazine 19 of FIG. 4 is illustrated once again in the two side views. It can be seen here that the upper narrower section 21 is respectively formed by a lower placed surface 22, 23 (recessed surface) on both sides of the magazine.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

The following is a listing of reference numbers and associated components of illustrated embodiments:

10—grip piece
11—mounting
12—barrel block
13—barrel
14—groove
15—cam
16—magazine mounting
17—wider lower section
18—narrower upper section
19—magazine
20—wider lower section
21—narrower upper section
22—lower placed surface
23—lower placed surface

What is claimed is:

1. A changeover system for a handgun, said system comprising:

a first grip piece of a handgun;

at least two different magazines for bullets of different caliber able to be inserted interchangeably into said first grip piece of a handgun;

at least a second grip piece of the same handgun type as said first grip piece of said handgun, provided for a smaller caliber, on which at least one security arrangement against interchangeability is provided, said at least one security arrangement against interchangeability which prevents the insertion of a magazine of a larger caliber into the second grip piece and comprises a partial constriction in a magazine mounting in the interior of the second grip piece, which engages a corresponding narrower section on the magazine of the smaller caliber but excludes the magazine of the larger caliber.

2. The changeover system according to claim 1, wherein narrower section of said magazine of the smaller caliber is in a front region, viewed in the insertion direction.

3. The changeover system according to claim 1, wherein the partial constriction is in an upper region of the magazine mounting of the second grip piece and begins approximately at a trigger height.

4. The changeover system according to claim 1, wherein the magazine of the smaller caliber has a base width equal to that of said magazine of the larger caliber.

5. The changeover system according to claim 1, wherein the magazine mounting in the second grip piece comprises a lower region with a width equal to that of a magazine mounting in the first grip piece.

6. The changeover system according to claim 1, comprising a first complete handgun configured exclusively for use with the smaller caliber cartridges and having an external appearance and external dimensions is largely identical to a handgun configured for said larger caliber cartridges, said first complete handgun comprising said security arrangement.

7. The changeover system according to claim 6, further comprising second complete handgun configured for use with said larger caliber cartridges, said second complete handgun being configured to receive either said first or said second cartridge.

* * * * *